US007443149B2

(12) United States Patent
Nishimura et al.

(10) Patent No.: US 7,443,149 B2
(45) Date of Patent: Oct. 28, 2008

(54) REGULATOR CIRCUIT CAPABLE OF DETECTING VARIATIONS IN VOLTAGE

(75) Inventors: Kazuhiko Nishimura, Kyoto (JP); Hiroki Inoue, Kyoto (JP); Nobuhiro Nishikawa, Kyoto (JP)

(73) Assignee: Rohm Co., Ltc. (JP)

( * ) Notice: Subject to any disclaimer, the term of this patent is extended or adjusted under 35 U.S.C. 154(b) by 412 days.

(21) Appl. No.: 11/190,289

(22) Filed: Jul. 27, 2005

(65) Prior Publication Data

US 2006/0022652 A1 Feb. 2, 2006

(30) Foreign Application Priority Data

Jul. 27, 2004 (JP) ..... 2004-219347
Jun. 21, 2005 (JP) ..... 2005-180476

(51) Int. Cl.
*G05F 1/40* (2006.01)

(52) U.S. Cl. ..... 323/280; 323/303

(58) Field of Classification Search ..... 323/312, 323/315, 280, 275, 284, 285, 299, 303
See application file for complete search history.

(56) References Cited

U.S. PATENT DOCUMENTS 5,170,333 A * 12/1992 Niwayama ..... 323/285
5,589,759 A * 12/1996 Borgato et al. ..... 323/285
5,999,007 A * 12/1999 Kimura ..... 324/760

FOREIGN PATENT DOCUMENTS

JP 2001-034351 2/2001

* cited by examiner

*Primary Examiner*—Jessica Han
(74) *Attorney, Agent, or Firm*—Cantor Colburn LLP

(57) ABSTRACT

A regulator circuit is provided which suppresses a variation in output voltage upon occurrence of a variation in input voltage or output current without any increase in steady-state power consumption.

17 Claims, 9 Drawing Sheets

REGULATOR CIRCUIT CAPABLE OF DETECTING VARIATIONS IN VOLTAGE

CROSS-REFERENCE TO RELATED APPLICATION

The present application claims priority from Japanese Patent Application No. JP 2004-219347 filed on Jul. 27, 2004 and from Japanese Patent Application No. JP-2005-180476 filed on Jun. 21, 2005.

BACKGROUND OF THE INVENTION

1. Field of the Invention

The present invention relates to a regulator circuit which stabilizes an input voltage for output.

2. Description of the Related Art

In some cases, to operate electronic circuits with stability, their supply voltages may be desirably stabilized at a constant value. Nevertheless, the supply voltage required by each electronic circuit is not always available in the apparatus in which the electronic circuits are incorporated. For example, a 5V microcomputer mounted in an automobile requires a supply voltage of 5V; however, the battery of the automobile supplies a voltage of 12V in an unstable manner. In such a case, a regulator circuit has been widely used to readily generate with stability the supply voltage required by the electronic circuit.

In general, the regulator circuit includes an error amplifier, an output transistor, and a feedback resistor. The error amplifier compares an output voltage fed back through the feedback resistor and a desired reference voltage to control the voltage at the control terminal of the output transistor so that the two voltages come close to each other. Accordingly, a variation in input voltage or load requires a change in voltage at the control terminal of the output transistor in response to the variation.

Here, in some cases, MOSFETs (Metal Oxide Semiconductor Field Effect Transistor) would be used as the output transistor to reduce current consumption. When the MOSFET is used, an increase in size of the transistor to ensure a larger current capacity leads to an increase in its gate capacitance, thereby causing the gate voltage controlled by the error amplifier to respond to the variation in input voltage or load with delay. This delay in turn may cause an overshoot or undershoot in the output voltage. A load, i.e., a change in output current also causes an overshoot or undershoot.

To address such problems, a technique has been suggested in which a current flowing from the output transistor into the load is monitored to increase the bias current of the error amplifier according to the monitored current, thereby providing an improved response speed to the regulator (for example, see Japanese Patent Laid-Open Publication No. 2001-34351).

When a large amount of current flows through the load, using the technique described in the document above allows a large bias current to flow also through the error amplifier, thus improving the response speed. However, a sudden decrease in the current flowing through the load leads to a corresponding decrease in the response speed, thereby possibly causing the output voltage to vary. It is also difficult to suppress a variation in output voltage caused by a change in input voltage.

SUMMARY OF THE INVENTION

The present invention was developed in view of the aforementioned problems. The invention may provide a regulator circuit which can suppress variations in output voltage resulting from a variation in input voltage or output current, without any increase in steady-state power consumption.

To address the aforementioned problems, a regulator circuit according to an aspect of the present invention comprises: an output transistor provided between an input terminal and an output terminal; an error amplifier which adjusts a voltage at a control terminal of the output transistor so that an output voltage appearing at the output terminal approaches a desired voltage; a detection circuit which detects a variation in voltage at a terminal which should have a stable potential to stabilize the output voltage; and an auxiliary circuit which forcedly changes the voltage at the control terminal of the output transistor when a variation in voltage has been detected by the detection circuit.

As used herein, the term "the control terminal of the output transistor" shall refer to the gate terminal in the case of the MOSFET and the base terminal in the case of the bipolar transistor. Also, the "terminal which should have a stable voltage to stabilize the output voltage" shall refer to a terminal at which its voltage is stabilized at a constant value in the stable state of the circuit, including the output voltage itself in addition to the input voltage or the like.

According to this aspect, since the detection circuit and the auxiliary circuit operate only during a transient variation in voltage, this allows for suppressing an overshoot or undershoot without any increase in current consumption under the steady state of the circuit and thus stabilizing the output voltage.

The detection circuit may include a detecting capacitor provided between the terminal which should have a stable potential and a terminal having a fixed potential, and may detect a variation in voltage by monitoring a transient current flowing through the detecting capacitor upon a variation in voltage at the terminal which should have a stable potential. It is to be understood that the "provision between terminals" shall refer to a direct connection between two terminals as well as a connection therebetween via a resistor or a transistor.

In a steady state of the circuit, no current flows because the ends of the detecting capacitor are at a constant voltage. However, a variation in input voltage or output voltage causes the voltage to change at one end, resulting in a transient current flowing for charging or discharging. The detection circuit can detect a variation in voltage by monitoring the transient current.

The auxiliary circuit may amplify the transient current flowing through the detecting capacitor to supply the amplified current to the control terminal of the output transistor, thereby forcedly increase the voltage at the control terminal.

In the case of the output transistor being a MOSFET, the gate capacitance is charged, whereas in the case of a bipolar transistor, the base current changes to turn on the transistor. As a result, the gate voltage or the base voltage is forcedly increased, thereby allowing a variation in output voltage, especially, an overshoot to be suppressed in a preferred manner. It is to be understood that the "amplifying a current" shall include increasing as well as decreasing the current.

The auxiliary circuit may also amplify the transient current flowing through the detecting capacitor to pull the amplified current from the control terminal of the output transistor, thereby forcedly decreasing the voltage of the control terminal. In this case, a variation in output voltage, particularly, an undershoot can be suppressed in a preferred manner.

Another aspect of the present invention also provides a regulator circuit. The regulator circuit comprises: an output transistor provided between an input terminal and an output terminal; an error amplifier which adjusts a voltage at a control terminal of the output transistor so that an output voltage appearing at the output terminal approaches a desired voltage; a detection circuit which detects a variation in voltage at a terminal which should have a stable potential to stabilize the output voltage; and an auxiliary circuit which enhances a response speed of the error amplifier when a variation in voltage has been detected by the detection circuit.

According to this aspect, the detection circuit and the auxiliary circuit enhance the response speed of the error amplifier only during a variation in the voltage at the input terminal which should have a stable potential or at the output terminal, thereby making it possible to suppress an overshoot or undershoot in the output voltage.

The detection circuit may include a detecting capacitor provided between the terminal which should have a stable potential and a terminal having a fixed potential, and may detect a variation in voltage by monitoring a transient current flowing through the detecting capacitor upon a variation in voltage at the terminal which should have a stable potential.

When the circuit is in a steady state, no current flows because the ends of the detecting capacitor are at a constant voltage. However, a variation in input voltage or output voltage causes the potential to change at one end, thereby allowing a current to flow for charging or discharging. The detection circuit can detect a variation in voltage by monitoring the transient charging or discharging current.

The auxiliary circuit may amplify the transient current flowing through the detecting capacitor to provide feedback so as to increase a bias current of a differential amplifier circuit provided in an input stage of the error amplifier. An increase in the bias current allows for accelerating the response speed of the error amplifier.

Here, the current gain of the auxiliary circuit needs not always to be one or more, but may preferably be one or less because the gain can be determined depending on the value of the current flowing through the detecting capacitor, the required response speed of the circuit, and the form of the circuit to which feedback is provided.

The auxiliary circuit may amplify the transient current flowing through the detecting capacitor to provide feedback to an output terminal of the differential amplifier circuit provided in the input stage of the error amplifier.

As used herein, the "output terminal of the differential amplifier circuit" shall refer to a portion to which a differential pair of transistors and loads of the transistors are connected. An amplified current can be connected to the output terminal of the differential amplifier circuit to forcedly change a current flowing through one of the differential pair of transistors. This allows for increasing the gradient of the differential voltage versus output voltage characteristic, i.e., the differential gain, thereby enhancing the response speed of the error amplifier.

Still another aspect of the present invention also provides a regulator circuit. The regulator circuit comprises: an output transistor provided between an input terminal and an output terminal; an error amplifier which adjusts a voltage at a control terminal of the output transistor so that an output voltage appearing at the output terminal approaches a desired voltage; and a detecting feedback capacitor which is connected between a terminal which should have a stable potential to stabilize the output voltage and a bias current source of a differential amplifier circuit provided in an input stage of the error amplifier.

According to this aspect, the detecting feedback capacitor serves as the detection circuit and the auxiliary circuit as described above. That is, a variation in voltage at the input terminal which should have a stable potential or the output terminal causes a current to flow through the detecting feedback capacitor, allowing the current to be fed back with an amplification factor of one remaining unchanged to the output of the differential amplifier circuit. As a result, the bias current of the differential amplifier circuit can be increased to enhance the response speed of the error amplifier, thereby allowing a variation in output voltage, particularly an overshoot, to be suppressed in a preferred manner.

Still another aspect of the present invention provides a regulator circuit. The regulator circuit comprises: an output transistor provided between an input terminal and an output terminal; an error amplifier which adjusts a voltage at a control terminal of the output transistor so that an output voltage appearing at the output terminal approaches a desired voltage; and a detecting feedback capacitor which is connected between a terminal which should have a stable potential to stabilize the output voltage and an output terminal of a differential amplifier circuit provided in an input stage of the error amplifier.

According to this aspect, a transient current flowing through the detecting feedback capacitor can be connected to the output terminal of the differential amplifier circuit to forcedly change a current flowing through one of a differential pair of transistors, thereby enhancing the response speed of the error amplifier.

Incidentally, any combinations of the foregoing components, and the expressions of the present invention converted among methods, apparatuses, systems, and the like are also intended to constitute applicable aspects of the present invention.

It is to be noted that any arbitrary combination or rearrangement of the above-described structural components and so forth are all effective as and encompassed by the present embodiments.

Moreover, this summary of the invention does not necessarily describe all necessary features so that the invention may also be sub-combination of these described features.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE INVENTION

The invention will now be described based on preferred embodiments which do not intend to limit the scope of the present invention but exemplify the invention. All of the features and the combinations thereof described in the embodiment are not necessarily essential to the invention.

First Embodiment

Figure 1:
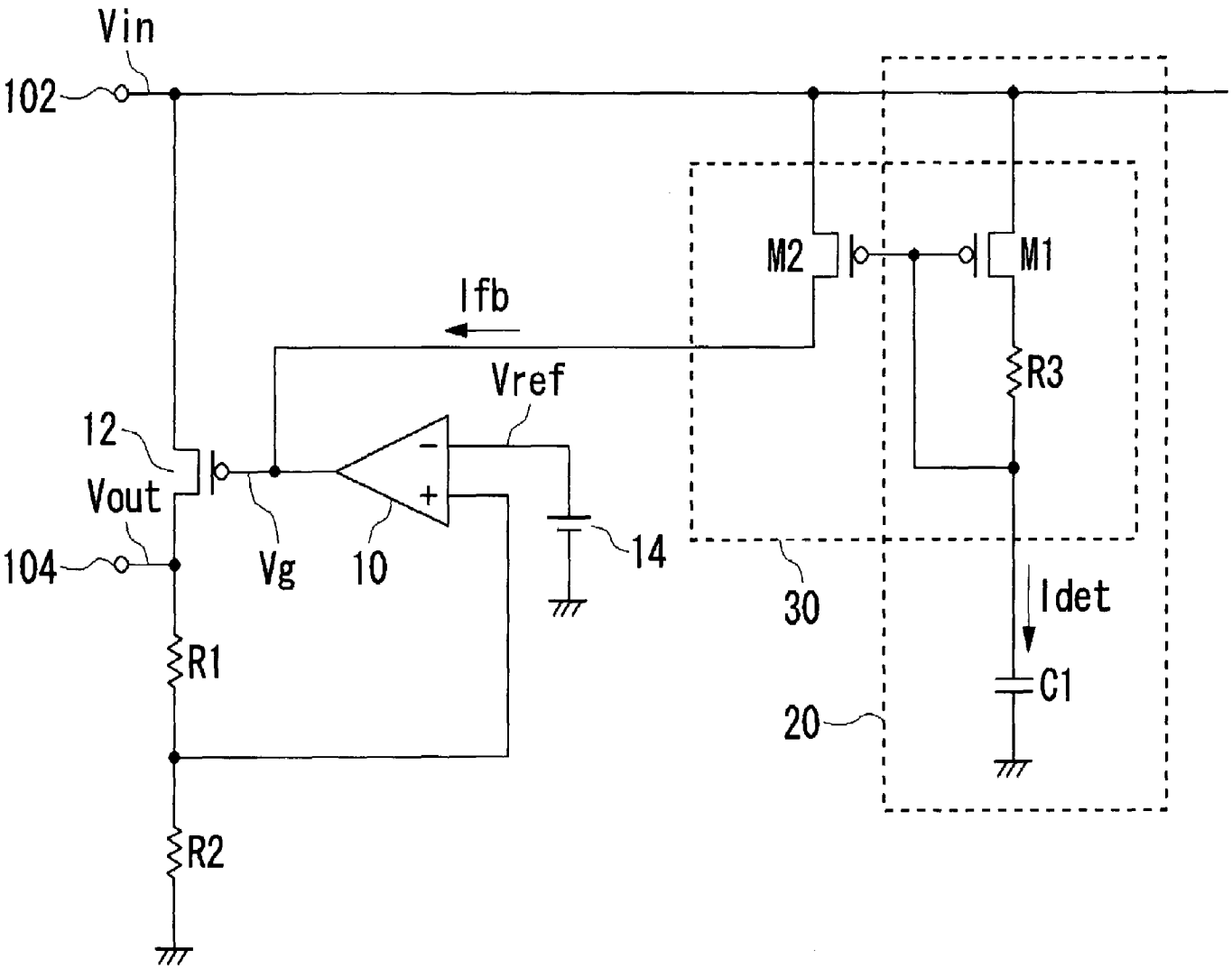
FIG. 1 is a circuit diagram showing the configuration of a regulator circuit according to a first embodiment.

FIG. 1 shows the configuration of a regulator circuit 100 according to a first embodiment of the present invention. Throughout the following drawings, like symbols indicate like components and will not be explained repeatedly where appropriate.

The regulator circuit 100 according to this embodiment includes a detection circuit 20 and an auxiliary circuit 30 in addition to an error amplifier 10, an output transistor 12, a first resistor R1, a second resistor R2, and a reference voltage source 14. The regulator circuit 100 includes an input terminal 102 and an output terminal 104. Hereinbelow, the voltages applied to or appearing at the input and output terminals are referred to as the input voltage Vin and the output voltage Vout, respectively.

The error amplifier 10, the output transistor 12, the first resistor R1, and the second resistor R2 form a typical linear regulator.

The output transistor 12 is provided between the input terminal 102 and the output terminal 104. The input voltage Vin is dropped so that the output voltage Vout becomes a desired voltage. The output transistor 12, which is a P-channel MOSFET in this embodiment, has a source terminal serving as the input terminal 102 of the regulator circuit 100 and a drain terminal serving as the output terminal 104 of the regulator circuit 100. The output transistor 12 also has a gate terminal connected with the output of the error amplifier 10, which controls a gate voltage Vg.

The error amplifier 10 has the inverting input terminal "−" which receives a reference voltage Vref delivered from the reference voltage source 14. The non-inverting input terminal "+" receives as a feedback input the output voltage Vout averaged by the voltage divider consisting of the first resistor R1 and the second resistor R2, i.e., Vout times R2/(R1+R2). The error amplifier 10 adjusts the gate voltage Vg of the output transistor 12 so that the inverting and non-inverting input terminals have an equal voltage. As a result, the output voltage Vout is stabilized irrespective of the value of the input voltage Vin in a manner such that Vout=(R1+R2)/R2×Vref.

The detection circuit 20 detects a variation in voltage at the input terminal 102 which should have a stable potential to stabilize the output voltage Vout. The detection circuit 20 includes a detecting capacitor C1, a first transistor M1, and a gain control resistor R3, which are connected in series between the input terminal 102 and a ground terminal.

When the circuit is in a steady state, no current flows through the first transistor M1 with the drain-source potential difference being 0V and a voltage drop across the gain control resistor R3 being also 0V. Thus, the input voltage Vin is supplied remaining unchanged to one end of the detecting capacitor C1.

An increase in the input voltage Vin applied to the input terminal 102 causes the high potential side voltage of the detecting capacitor C1 to increase following the input voltage Vin. As a result, a transient detecting current Idet flows to charge the detecting capacitor C1, thereby allowing the detection circuit 20 to detect a variation in the input voltage Vin.

The auxiliary circuit 30 amplifies the detecting current Idet into a feedback current Ifb, which is in turn fed back to the gate terminal or the control terminal of the output transistor 12. The auxiliary circuit 30 includes the first transistor M1, a second transistor M2, and the gain control resistor R3. The first transistor M1 and the second transistor M2 form a current mirror circuit, with the drain terminal of the second transistor being connected to the gate terminal or the control terminal of the output transistor 12.

The detecting current Idet that flows through the detecting capacitor C1 upon detection of a variation in the input voltage Vin is supplied from the first transistor M1. This current is amplified through the second transistor M2 to be supplied as the feedback current Ifb to the gate terminal of the output transistor 12. The ratio between the feedback current Ifb and the detecting current Idet can be adjusted by the size ratio between the first and second transistors M1 and M2, and the gain control resistor R3. That is, to increase the current gain, the size ratio or the gain control resistor R3 may be set a large value.

Figure 2:
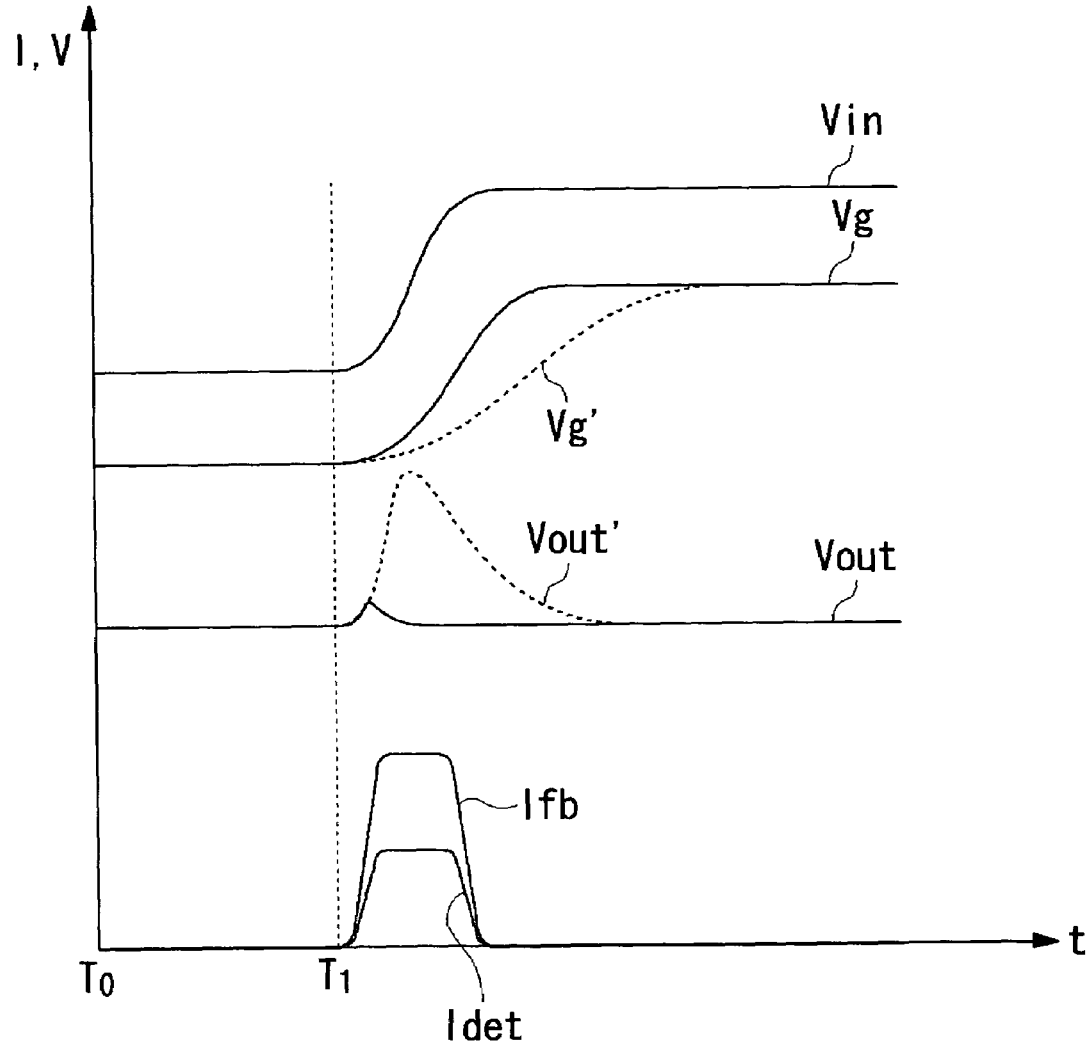
FIG. 2 is a view showing the voltage and current waveforms in the regulator circuit with respect to time when an input voltage is suddenly increased.

Now, referring to FIG. 2, a description will be made to the operation of the regulator circuit 100 configured as such. FIG. 2 shows the voltage and current waveforms in the regulator circuit 100 with respect to time when the input voltage Vin is suddenly increased.

To facilitate the understanding of the regulator circuit 100 functioning to suppress variations in output according to this embodiment, a description will be first made to the operation performed without using the detection circuit 20 and the auxiliary circuit 30. A gate voltage Vg' and an output voltage Vout' indicated by dashed lines in FIG. 2 show the voltage waveforms obtained in this operation.

During time T0 to T1, the input voltage Vin takes on a constant value while the circuit is in a steady state and the output voltage is regulated such that Vout=(R1+R2)/R2×Vref. Suppose that a sudden change has occurred in the input voltage Vin at time T1.

Since there exists a gate capacitance Cg between the gate and source terminals of the output transistor 12 in the regulator circuit 100, it is necessary to charge or discharge the gate capacitance Cg in order to change the gate voltage Vg'. Here, in terms of the gate capacitance Cg and a charge or discharge current I, the rate of change of the gate voltage Vg' with time can be expressed as dVg'/dt=I/Cg, which is inversely proportional to the gate capacitance. Accordingly, a large gate capacitance Cg of the output transistor 12 causes the gate voltage Vg' to change with a significant delay relative to a variation in the input voltage Vin or the output voltage Vout.

Since the gate voltage Vg' cannot follow a sudden increase in the input voltage Vin or the source voltage, the gate-source voltage of the output transistor 12 increases temporarily. This results in a temporary increase in the output voltage Vout' or the drain voltage, causing an overshoot to occur.

Now, a description will be made to the case where the regulator circuit 100 according to this embodiment is operated using the detection circuit 20 and the auxiliary circuit 30 to prevent the overshoot, with reference to the voltage waveforms Vg and Vout shown by solid lines in FIG. 2.

During time T0 to T1, the circuit is in a steady state, and an increase in the input voltage Vin occurs at time T1. The increase in the input voltage Vin causes the detecting current Idet to flow into the detecting capacitor C1 of the detection circuit 20. Using the capacitance value C1 of the detecting capacitor, the detecting current Idet is given by Idet≈C1×dVin/dt. Accordingly, in FIG. 2, the detecting current Idet is generally proportional to the waveform obtained by differentiating the input voltage Vin with respect to time, and flows only when a change occurs in the input voltage Vin.

In the auxiliary circuit 30, the detecting current Idet is amplified into a feedback current Ifb. As described above, the current gain is defined based on the first and second transistors M1 and M2 and the gain control resistor R3. The feedback current Ifb amplified through the auxiliary circuit 30 flows into the gate terminal of the output transistor 12, forcedly charging the gate capacitance Cg of the output transistor 12. The relation dVg'/dt=I/Cg means that the charge current I increases by the feedback current Ifb thereby causing the rate of change of the gate voltage Vg with time to increase. As shown with a solid line in FIG. 2, the gate voltage Vg rises more quickly than the Vg' shown by the dashed line.

As a result, the gate-source voltage of the output transistor 12 is adjusted to an appropriate value even when the input voltage Vin or the source voltage has changed. Thus, as shown with the solid line, the output voltage Vout is stabilized with the overshoot suppressed.

As such, in the regulator circuit 100 according to this embodiment, the detection circuit 20 can detect the transient detecting current Idet that flows only during a variation in the input voltage Vin, and then amplify the current to be supplied to the gate terminal of the output transistor 12. This makes it possible to forcedly increase the gate voltage Vg and thereby prevent an overshoot.

The detecting current Idet and the feedback current Ifb are proportional to the differential of the input voltage Vin with respect to time as described above, thus flowing only during a variation with time. Accordingly, the regulator circuit 100 according to this embodiment can suppress an overshoot in the output voltage Vout without any increase in steady state current consumption.

Figure 3:
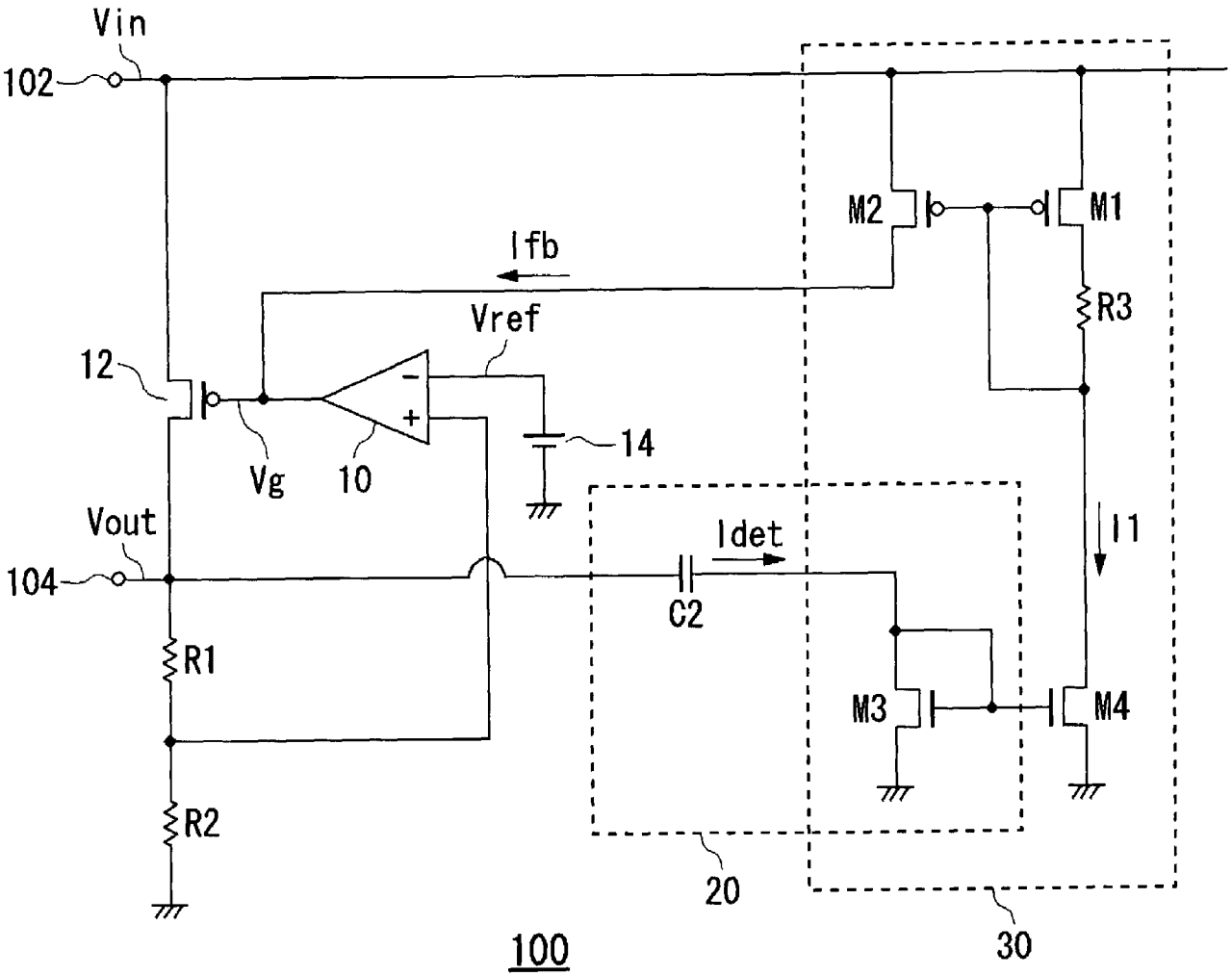
FIG. 3 is a view showing a modified example of the regulator circuit according to the first embodiment.

FIG. 3 shows a modified example of the regulator circuit 100 according to this embodiment. In this modified example, the detection circuit 20 directly detects a variation in the output voltage Vout at a terminal which should have a stable potential to stabilize the output voltage Vout.

In this modified example, a detecting capacitor C2 is connected to the output terminal 104, in which a variation in the output voltage Vout causes the detecting current Idet to flow.

A sudden decrease in output current resulting from a variation in a load circuit connected to the output terminal 104 causes the output voltage Vout to start rising. As a result, the detecting current Idet flows into the detecting capacitor C2. The detecting current Idet is amplified based on the size ratio between a third transistor M3 and a fourth transistor M4. The amplified current I1 is in turn amplified in the first transistor M1 and the second transistor M2 and then fed back as the feedback current Ifb to the gate terminal of the output transistor 12, thereby forcedly increasing the gate voltage Vg. As a result, the gate-source voltage of the output transistor 12 is reduced causing the output current from the output transistor 12 to decrease, thereby suppressing an overshoot in the output voltage Vout in a preferred manner.

Likewise, in this modified example, a sudden increase in the input voltage Vin also causes an increase in the output voltage Vout. Accordingly, this makes it possible to suppress an overshoot resulting from a variation in the input voltage Vin by monitoring a variation in the output voltage Vout.

Second Embodiment

In the first embodiment, a variation in the circuit detected by the detection circuit 20 is fed back to the gate terminal of the output transistor 12, thereby suppressing an overshoot. A second embodiment, which will be explained below, allows a voltage variation detected by the detection circuit 20 to be fed back to the error amplifier 10 that forms the regulator circuit 100 so as to increase the gain and the response speed of the error amplifier 10. This allows the responsivity of the regulator circuit to be improved only during a transient state of the circuit.

Figure 4:
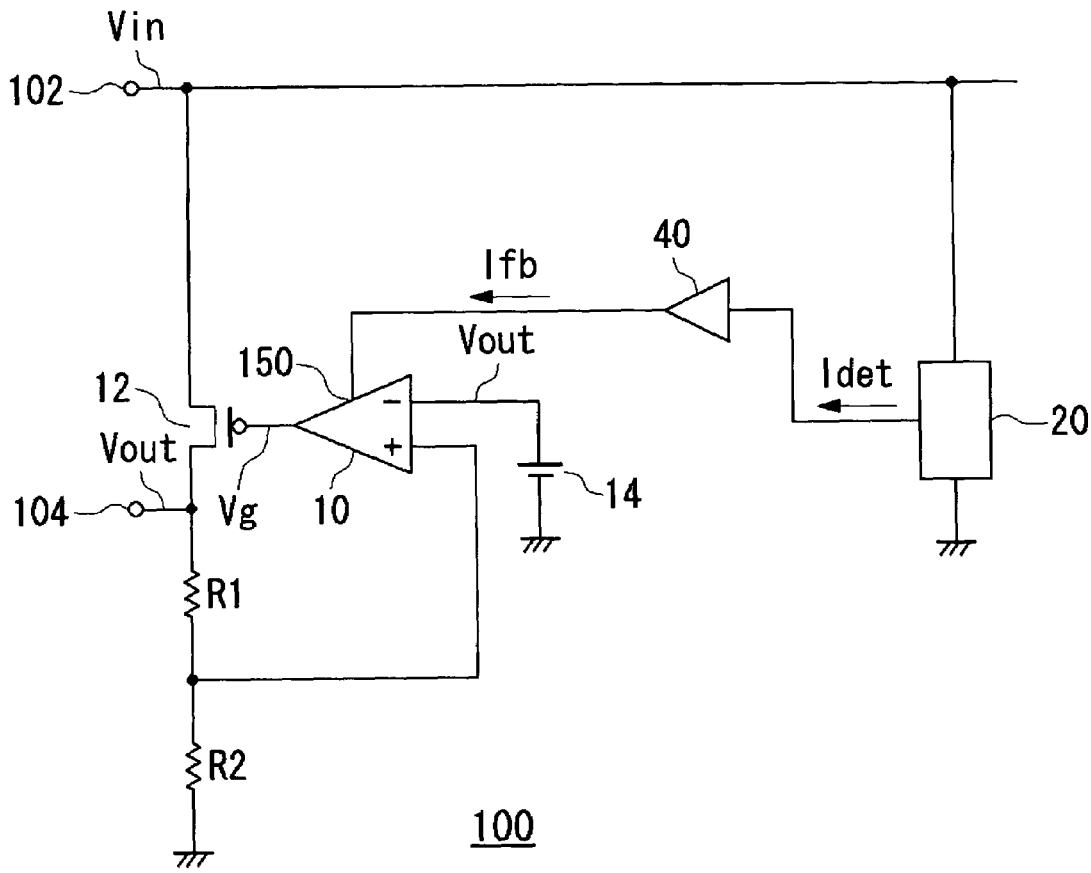
FIG. 4 is a circuit diagram showing the configuration of a regulator circuit according to a second embodiment.

FIG. 4 shows the configuration of the regulator circuit 100 according to the second embodiment. The regulator circuit 100 includes the error amplifier 10, the output transistor 12, the reference voltage source 14, the first resistor R1, the second resistor R2, the detection circuit 20, and an auxiliary circuit 40.

The detection circuit 20, which is connected to the input terminal 102, detects a variation in the input voltage Vin. The detection circuit 20 may be configured in the same manner as in the first embodiment. The auxiliary circuit 40 allows a variation detected by the detection circuit 20 to be fed back as the feedback current Ifb to a feedback terminal 150 of the error amplifier 10.

Figure 5:
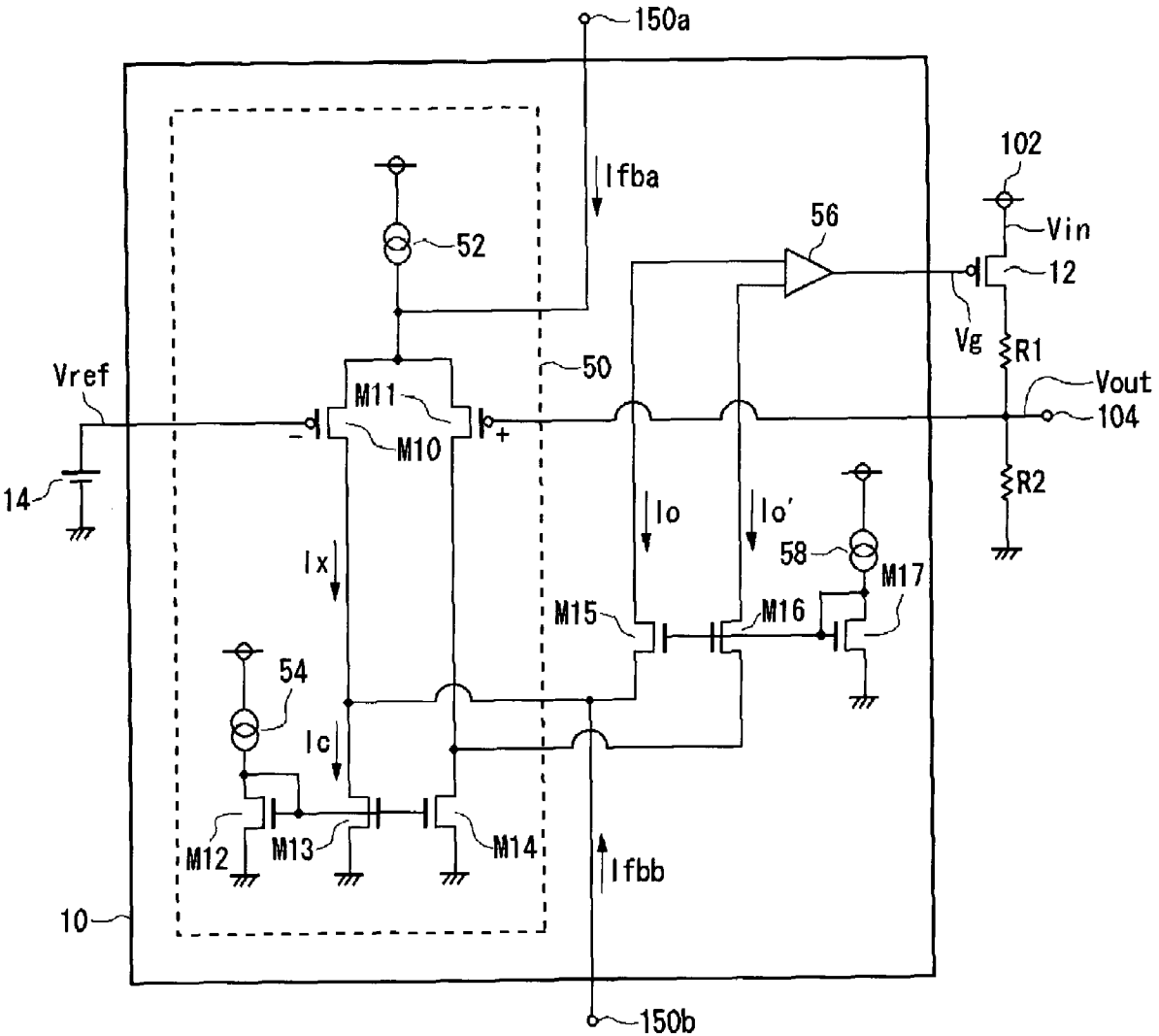
FIG. 5 is a circuit diagram showing the internal configuration of an error amplifier, especially showing in detail a differential amplifier circuit provided in an input stage.

FIG. 5 shows the internal configuration of the error amplifier 10, especially illustrating in detail a differential amplifier circuit 50 provided in an input stage. The differential amplifier circuit 50 includes a differential pair of transistors M10 and M11, a constant-current source 52 for supplying a bias current to the differential amplifier circuit 50, and transistors M13 and M14 serving as a constant-current load.

The gate terminals of the transistors M10 and M11 correspond to the inverting and non-inverting input terminals of the error amplifier 10, respectively. The gate terminal of the transistor M10 receives the reference voltage Vref, while the gate terminal of the transistor M11 is supplied as feedback with the output voltage Vout averaged by the voltage divider, i.e., Vout times R2/(R1+R2).

The transistors M10 to M16 are symmetrically connected; their configuration will now be explained with reference to the transistors M10, M13, and M15.

The transistor M13, which is controlled by a constant-current source 54 and the transistor M12 to allow a constant current Ic to flow therethrough, serves as a constant-current load. The constant current Ic flowing through the transistor M13 is the sum of the current Ix flowing through the M10 and the current Io flowing through the transistor M15. Thus, it holds that Io=Ic−Ix. The transistors M11, M14, and M16 are related to each other in a similar manner, allowing a current Io' to flow through the transistor M16. The gate terminals of the transistors M15 and M16 are commonly connected to the gate terminal of a transistor M17, which is supplied with a predetermined constant current from a constant-current source 58. The transistors M15 and M16 serve as a transistor amplifier for amplifying the output signal from the differential amplifier circuit 50, and the currents Io and Io' flowing respectively therethrough are delivered via an output stage 56 of the error amplifier 10. The output terminal of the output stage 56 is connected to the gate terminal of the output transistor 12.

The terminals 150*a* and 150*b* shown in FIG. 5 correspond to the feedback terminal 150 to which the auxiliary circuit 40 is connected in FIG. 4. That is, in FIG. 4, the feedback current Ifb delivered from the auxiliary circuit 40 is fed back to either the feedback terminal 150*a* or 150*b* in the circuit diagram of FIG. 5. A description is now made to the operation which is performed when feedback is provided to each of the feedback terminals 150*a* and 150*b*.

When feedback is provided to the feedback terminal 150*a*, an increase in the input voltage Vin causes a transient feedback current Ifba to flow. Since the feedback current Ifba can be considered to be a current source provided in parallel to the constant-current source 52 in the differential amplifier circuit 50 shown in FIG. 5, a bias current (tail current) supplied to the differential pair of M10 and M11 of the differential amplifier circuit 50 increases in a transient manner.

The response speed of the error amplifier 10 depends on the bias current supplied to the differential pair of M10 and M11; the larger the current, the faster the response speed. The feedback current Ifba enhances the response speed of the error amplifier 10, so that the gate voltage Vg of the output transistor 12 can sharply increase following the variation in the input voltage as shown with a solid line in FIG. 2. This makes it possible to suppress an overshoot in the output voltage Vout in a preferred manner.

A description will now be made to the case where feedback is provided to the feedback terminal 150*b*. An increase in the input voltage Vin causes a feedback current Ifbb to flow into the feedback terminal 150*b* of the error amplifier 10.

At this time, between the current Io flowing through the transistor M15, the current Ix flowing through the transistor M10, the feedback current Ifbb, and the constant current Ic flowing through the transistor M13, it holds that Ic=Ix+Io+Ifbb, with the current Io expressed by Io=Ic−Ix−Ifbb. Therefore, the current Io decreases as the feedback current Ifbb increasingly flows into the error amplifier 10. A decrease in the current Io is equivalent to an increase in the voltage at the inverting input terminal "−" resulting in an increase in the current Ix, or to a decrease in the voltage at the non-inverting input terminal "+" resulting in an increase in the current Ix.

Therefore, when the input voltage Vin increases resulting in an increase in the feedback current Ifbb, the output from the error amplifier 10, i.e., the gate voltage Vg of the output transistor 12 increases. As a result, feedback is provided so as to reduce the output voltage Vout from the regulator circuit 100 or the drain voltage of the output transistor 12, thus suppressing an overshoot.

Viewed from another aspect, the feedback of the feedback current Ifbb to the feedback terminal 150*b* can also be considered to enhance the response speed of the error amplifier 10 by increasing the differential gain of the transistors M10 and M11 forming the differential pair.

Conversely, a decrease in the input voltage Vin causes the feedback current Ifbb to flow out of the error amplifier 10. As a result, the current Io increases resulting in a decrease in the output from the error amplifier 10, i.e., in the gate voltage Vg of the output transistor 12. This causes feedback to be provided so that the output Vout from the regulator circuit 100 to increase, thus suppressing an undershoot.

As described above, this embodiment allows the detection circuit 20 to detect a variation in the input voltage Vin and the auxiliary circuit 40 to provide feedback directly to the error amplifier 10, thereby accelerating the response speed of the error amplifier 10. Accordingly, it is possible to control either an undershoot or overshoot in a preferred manner in response to a variation in the input voltage Vin by selecting an appropriate feedback terminal.

Furthermore, since the feedback current Ifb flows in a transient manner due to a variation in the input voltage Vin, no increase occurs in current consumption of the regulator circuit 100 during its steady-state condition.

On the other hand, as shown in FIG. 4, this embodiment allows the detection circuit 20 to be connected to the input terminal 102 to detect a variation in the input voltage Vin. However, the same effect can also be obtained by connecting the detection circuit 20 to the output terminal 104 to detect a variation in the output voltage Vout.

Figure 6:
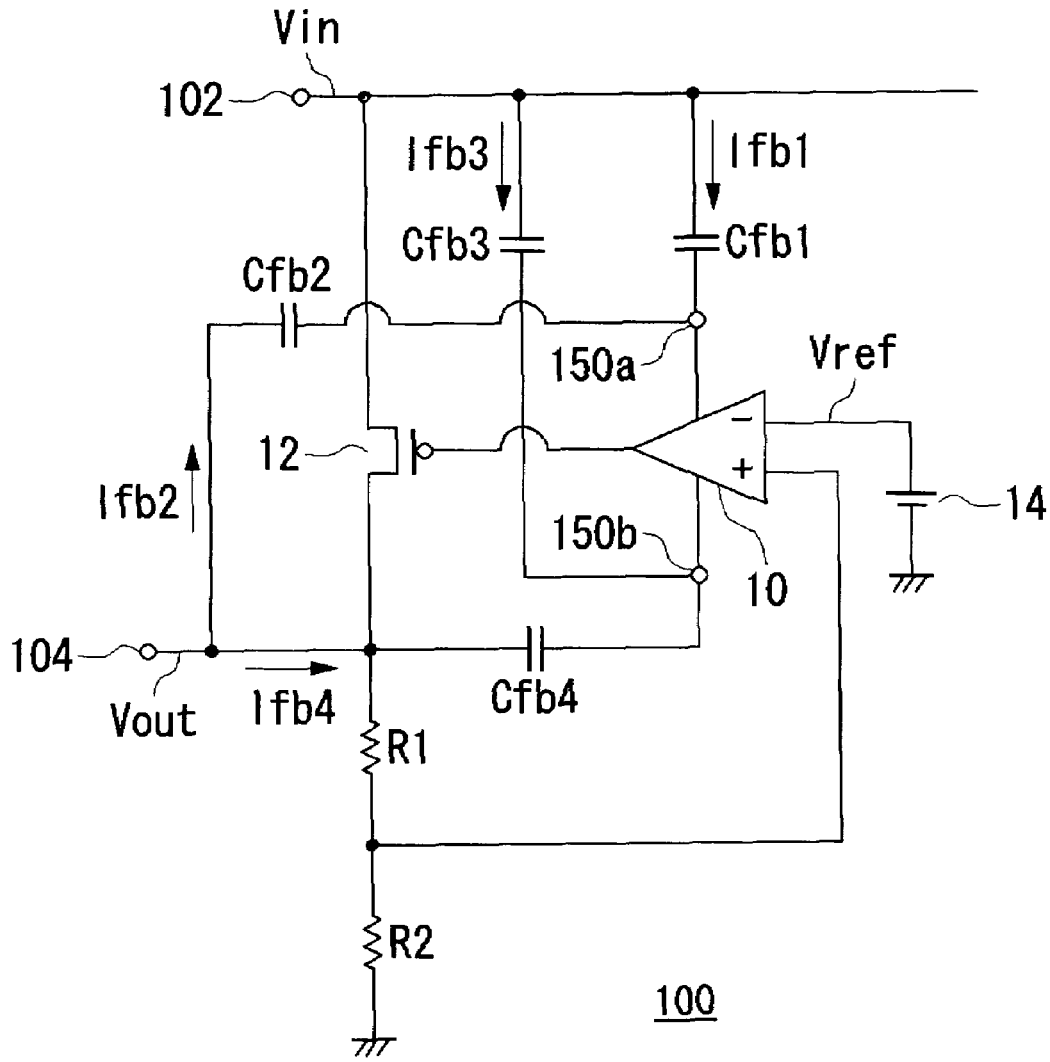
FIG. 6 is a view showing a modified example of the regulator circuit according to the second embodiment.

FIG. 6 shows a modified example of this embodiment. In this modified example, there are provided detecting feedback capacitors Cfb1 to Cfb4 in place of the detection circuit 20 and the auxiliary circuit 40 of FIG. 4. This is an exemplary circuit for suppressing an overshoot and undershoot in a simple manner. The terminals 150*a* and 150*b* of the error amplifier 10 to which feedback is provided through these detecting feedback capacitors Cfb1 to Cfb4 correspond to the feedback terminals 150*a* and 150*b* of FIG. 5, respectively.

The detecting feedback capacitor Cfb1 is provided between the input terminal 102 and the feedback terminal 150*a*. An increase in the input voltage Vin causes a transient current to flow to charge the detecting feedback capacitor Cfb1, allowing a feedback current Ifb1 to flow from the feedback terminal 150*a* into the error amplifier 10. As a result, the currents flowing through the transistors M10 and M11 forming the differential pair in the differential amplifier circuit 50 shown in FIG. 5 increase. This allows for enhancing the response speed of the error amplifier 10, thereby suppressing an overshoot in a preferred manner.

The detecting feedback capacitor Cfb2 is provided between the output terminal 104 and the terminal 150*a*. An increase in the output voltage Vout causes a feedback current Ifb2 to flow into the error amplifier 10 to charge the detecting feedback capacitor Cfb2. This allows for enhancing the response speed of the error amplifier 10, thereby suppressing an overshoot in a preferred manner.

The detecting feedback capacitor Cfb3 is provided between the input terminal 102 and the feedback terminal 150*b*. An increase in the input voltage Vin causes a transient current to flow into the detecting feedback capacitor Cfb1, allowing a feedback current Ifb3 to flow from the feedback terminal 150*b* into the error amplifier 10. This current raises the differential gain of the error amplifier to enhance the response speed of the amplifier, thereby making it possible to suppress an overshoot.

In contrast to this, a decrease in the input voltage Vin causes the feedback current Ifb3 to flow in the opposite direction, thereby allowing feedback to be provided to suppress an undershoot.

Likewise, the detecting feedback capacitor Cfb4 can suppress an overshoot and undershoot through the same operation as that of the detecting feedback capacitor Cfb3 by monitoring a variation in the output voltage Vout.

As described above, the detecting feedback capacitors Cfb1 to Cfb4 have the functionality as a detection circuit for detecting a voltage variation at a terminal which should have a stable potential to stabilize the output voltage Vout as well as the functionality as an auxiliary circuit for enhancing the response speed of the error amplifier when a voltage variation has been detected by the detection circuit. Using the differential of voltage with respect to time dV/dt and a capacitance value, the feedback current value is given by Ifb=Cfb×dV/dt. This allows for adjusting the amount of feedback by appropriately selecting the capacitance value of the detecting feedback capacitors Cfb1 to Cfb4, thereby suppressing variations in output voltage in a preferred manner.

Although illustrated in the same circuit diagram, the detecting feedback capacitors Cfb1 to Cfb4 are not limited to the simultaneous use; since each detecting feedback capacitor functions independently, it may be installed where necessary as required.

It is to be understood by those skilled in the art that this embodiment is only illustrative, and various modifications and changes can be made to the combination of its components and processes without departing from the scope and spirit of the present invention.

In the first embodiment, the detection circuit 20 of the regulator circuit 100 of FIG. 1 is effective for suppressing an increase in the gate voltage Vg, i.e., an overshoot because a variation in the input voltage Vin causes the detecting current Idet to flow toward the ground and the feedback current Ifb to flow only into the gate terminal of the output transistor 12. Conversely, the circuit may also be configured such that a decrease in the input voltage Vin or the output voltage Vout causes the feedback current Ifb to flow out of the gate terminal of the output transistor 12. Such a circuit configuration makes it possible to suppress an undershoot in the output voltage Vout in contrast to that of the regulator circuit 100 of FIG. 1.

In the first embodiment, a MOSFET was employed as the output transistor 12; however, a bipolar transistor can also be used to obtain the effect of preventing an overshoot. That is, in the case of the MOSFET, the feedback current Ifb is used to charge its gate capacitance; in the case of the bipolar transistor, the base current can be changed to forcedly vary the collector current, thereby suppressing an overshoot.

In the second embodiment, it is also possible to employ other than the feedback terminals 150*a* and 150*b* shown in FIG. 5 to provide feedback to enhance the response speed of the error amplifier 10 or to cancel a variation in the input voltage Vin or the output voltage Vout when a voltage variation has been detected at the terminal which should have a stable potential. The form of the feedback may be selected as appropriate in accordance with the configuration of the error amplifier 10, and the direction and magnitude of the feedback current Ifb.

Figure 7:
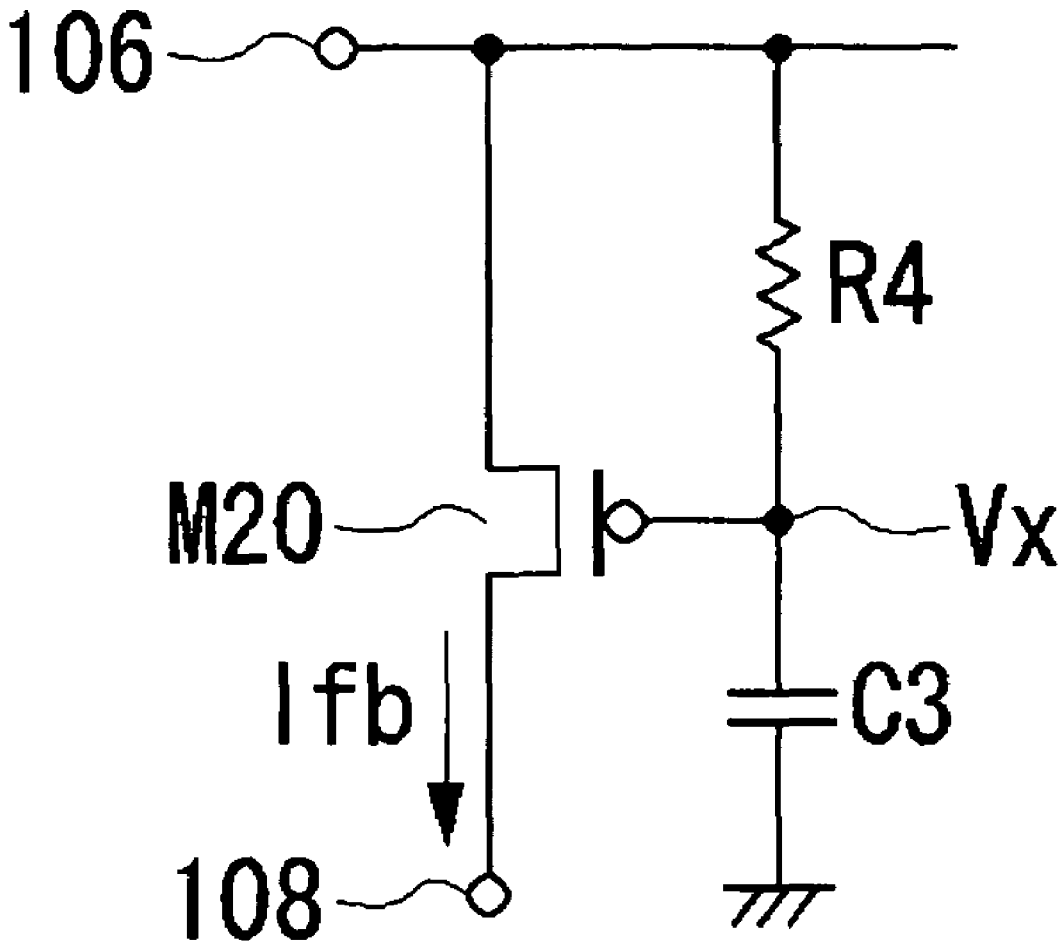
FIG. 7 is a view showing a modified example of the combination of a detection circuit and an auxiliary circuit.

In the first or second embodiment, the detection circuit 20 and the auxiliary circuit 30 or the detection circuit 20 and the auxiliary circuit 40 may also be configured as shown in FIG. 7. FIG. 7 is a circuit diagram showing a modified example of the combination of the detection circuit 20 and the auxiliary circuit 30. A terminal 106 is connected to the input voltage Vin or the output voltage Vout of the regulator circuit 100. A resistor R4 and a capacitor C3 are provided in series between the terminal 106 and the ground. A voltage Vx at the connection between the resistor R4 and the capacitor C3 rises according to the time constant of CR, and thus delays in time relative to a variation at the terminal 106 even in the case of an increase in voltage at the terminal 106. The voltage Vx being applied to the gate terminal of a transistor M20 causes the gate-source voltage of the transistor M20 to increase in a transient manner resulting in the transistor M20 being turned on, thereby allowing the feedback current Ifb to flow therethrough. A drain terminal 108 of the transistor M20 may be connected to the gate terminal of the output transistor 12 or to the feedback terminals 150*a* and 150*b* of the detection circuit 20, thereby making it possible to provide the respective effects as described in the embodiments above.

The duration in which the transistor M20 is in an ON state can be adjusted with the time constant that is determined by the resistor R4 and the capacitance value C3, and thus may be selected according to the feedback destination to which the drain terminal 108 is connected or the level of voltage variation. With this circuit, it is also possible to suppress current consumption because of no increase in current in the steady state circuit.

Figure 8:
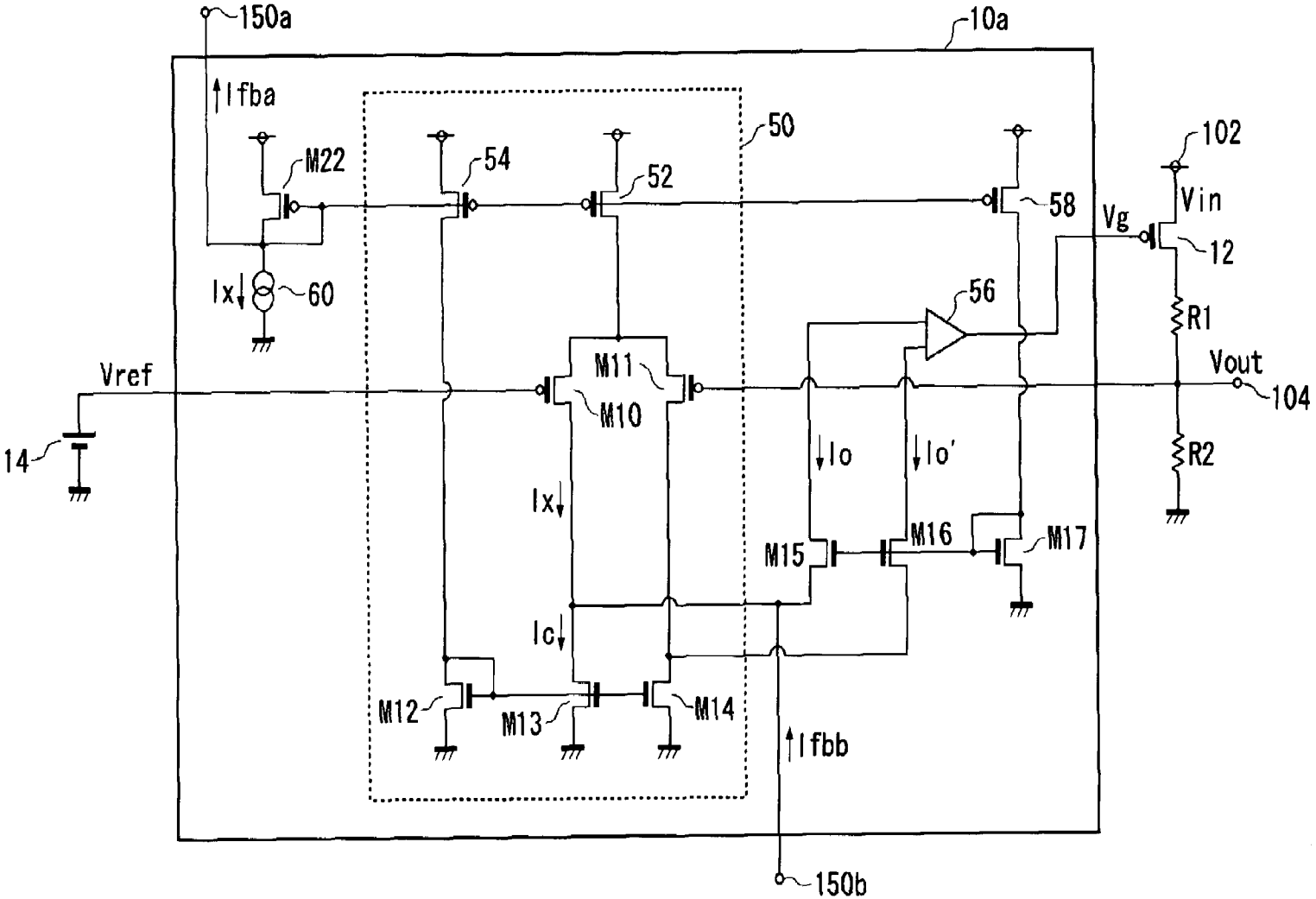
FIG. 8 is a circuit diagram showing a modified example of the differential amplifier circuit of FIG. 5.

FIG. 8 is a circuit diagram showing a modified example of the differential amplifier circuit 10 of FIG. 5. Now, a description will be made on an error amplifier 10*a* of FIG. 8 with attention being focused on the difference from FIG. 5. In the error amplifier 10*a* of FIG. 8, the constant-current sources 52, 54, and 58 are formed of P-channel MOSFETs with the gate terminals connected in common. The P-channel MOSFETs constituting the constant-current sources 52, 54, and 58, and a transistor M22 of the same P-channel MOSFET form a current mirror circuit. The drain terminal of the transistor M22 is connected with a constant-current source 60 for generating the constant current Ix. In the error amplifier 10*a* of FIG. 8, the connection between the transistor M22 and the constant-current source 60 is the feedback terminal 150*a*. The current flowing through the transistor M22 is given by the sum of the constant current Ix and the feedback current Ifba, i.e., (Ix+Ifba). That is, the current generated by the constant-current sources 52, 54, and 58 varies with a change in the feedback current Ifba.

In the error amplifier 10 of FIG. 5, the feedback current Ifba causes a change only in the tail current of the differential pair including the transistors M10 and M11 that is generated by the constant-current source 52. On the other hand, in the error amplifier 10*a* of FIG. 8, the constant currents that are generated by the constant-current source 54 and the constant-current source 58 in addition to the constant-current source 52 also increase or decrease according to the feedback current Ifba. Here, the constant current generated by the constant-current source 54 adjusts the bias of the transistors M13 and M14 or a constant-current load, while the constant current generated by the constant-current source 58 adjusts the bias of the transistors M15 and M16 that amplify the output signal from the differential amplifier circuit 50. Accordingly, the error amplifier 10*a* of FIG. 8 allows a change in the bias currents of the transistors M13 and M14 and the transistors M15 and M16 according to an increase or decrease in the feedback current Ifba, thereby making it possible to enhance the response speed of the error amplifier 10*a* and suppressing a variation in the output voltage Vout in a more preferred manner.

The components described in accordance with the embodiments and their modified examples can be used not only alone but also in any combination, thereby suppressing an overshoot or undershoot in a preferred manner.

The embodiments have employed the FET as the transistors. However, it is also possible to employ other-channels of transistors such as the bipolar transistor. The transistor may be selected according to the design specification required for the regulator circuit, the semiconductor manufacturing process employed or the like.

In the embodiments, all the components forming the regulator circuit 100 may be integrated with each other or part thereof may be formed of discrete components. It may be determined based on the cost or occupied area which parts to integrate.

Figure 9:
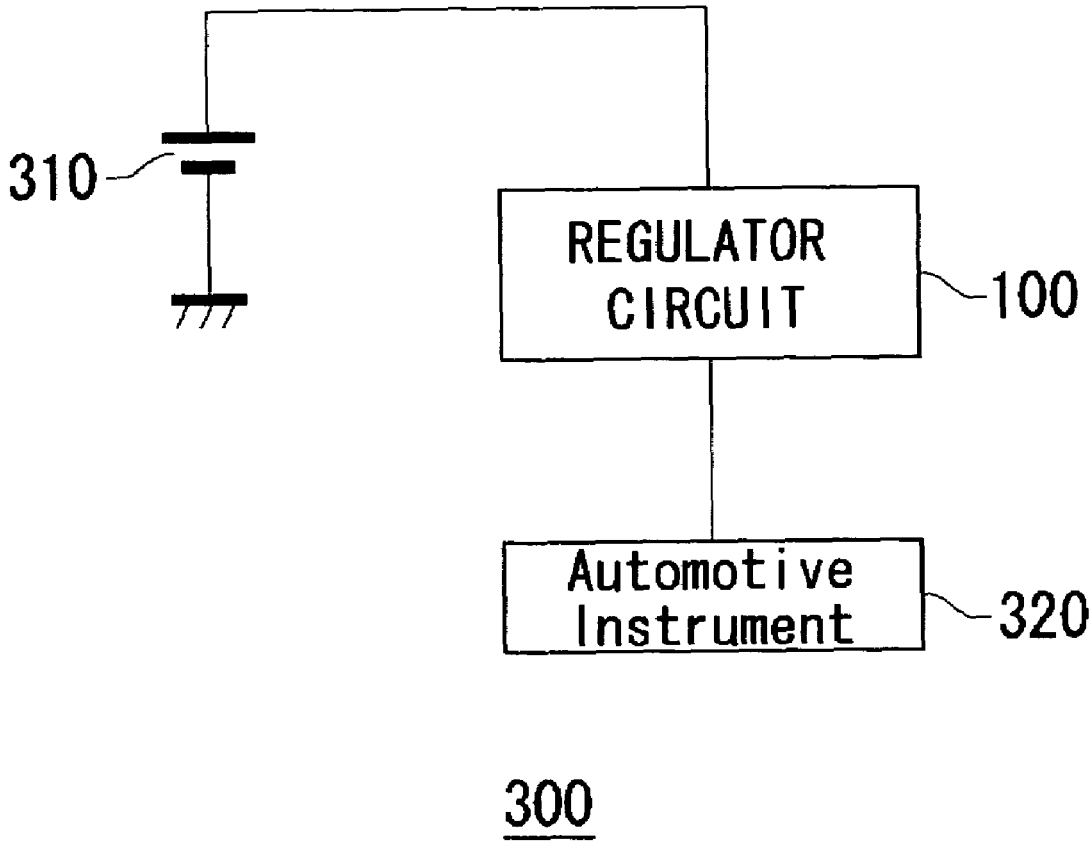
FIG. 9 is a block diagram showing part of an automobile which incorporates the regulator circuit according to the first or second embodiment.

For example, the regulator circuit 100 according to the first and second embodiments is mounted in an automobile. FIG. 9 is a block diagram showing an electrical system of an automobile 300 which incorporates the regulator circuit 100 according to the first or second embodiment. The automobile 300 includes a battery 310, the regulator circuit 100, and an automotive instrument 320. The battery 310 delivers a battery voltage Vbat of about 12V. The battery voltage Vbat is delivered via a relay, and thus varies greatly with time. On the other hand, for example, the automotive instrument 320 is a load, such as a car stereo, a car navigation system, an illuminating LED for the interior panel or the like, which requires a stable supply voltage that does not vary with time. The regulator circuit 100 steps the battery voltage Vbat down to a predetermined voltage for output to the automotive instrument 320.

As described above, the regulator circuit 100 described in accordance with the embodiments tracks at high speed a sudden change in input voltage Vin or output voltage Vout, minimizing variations in the output voltage Vout. Accordingly, the regulator circuit 100 can be used in a preferred manner to stabilize a power supply, such as an automobile mounted battery, which varies greatly in voltage.

Furthermore, the regulator circuit 100 described in accordance with the embodiments is not limited to the use for automobiles but can be employed for various applications in which a stabilized input voltage should be supplied to a load.

While the preferred embodiments of the present invention have been described using specific terms, such description is for illustrative purposes only, and it is to be understood that changes and variations may be made without departing from the spirit or scope of the appended claims.

What is claimed is:

1. A linear regulator circuit comprising:

an output transistor provided between an input terminal and an output terminal;

an error amplifier which adjusts a voltage at a control terminal of the output transistor so that an output voltage appearing at the output terminal approaches a desired voltage;

a detection circuit which detects a variation in voltage at a terminal which should have a stable potential to stabilize the output voltage, the terminal being the input terminal or the output terminal; and an auxiliary circuit which forcedly changes the voltage at the control terminal of the output transistor when a variation in voltage has been detected by the detection circuit.

2. The linear regulator circuit according to claim 1, wherein the detection circuit includes a detecting capacitor provided between the terminal which should have a stable potential and a terminal having a fixed potential, and detects a variation in voltage by monitoring a transient current flowing through the detecting capacitor upon a variation in voltage at the terminal which should have a stable potential.

3. The linear regulator circuit according to claim 2, wherein auxiliary circuit amplifies the transient current flowing through the detecting capacitor to supply the amplified current to the control terminal of the output transistor, thereby forcedly increase the voltage at the control terminal.

4. The linear regulator circuit according to claim 2, wherein auxiliary circuit amplifies the transient current flowing through the detecting capacitor to pull the amplified current from the control terminal of the output transistor, thereby forcedly decreasing the voltage of the control terminal.

5. The linear regulator circuit according to claim 1, wherein the detection circuit includes a detecting capacitor and a first transistor which are serially provided between the terminal which should have a stable potential and a terminal having a fixed potential, and the auxiliary circuit includes a second transistor which forms a current mirror circuit with the first transistor, to forcedly change a voltage at the control terminal of the output transistor by a current flowing through the second transistor.

6. An automobile comprising:

a battery; and the linear regulator circuit according to claim 1 which stabilizes a voltage from the battery for output to a load.

7. A linear regulator circuit comprising:

an output transistor provided between an input terminal and an output terminal;

an error amplifier which adjusts a voltage at a control terminal of the output transistor so that an output voltage appearing at the output terminal approaches a desired voltage;

a detection circuit which detects a variation in voltage at a terminal which should have a stable potential to stabilize the output voltage, the terminal being the input terminal or the output terminal; and an auxiliary circuit which enhances a response speed of the error amplifier when a variation in voltage has been detected by the detection circuit.

8. The linear regulator circuit according to claim 7, wherein the detection circuit includes a detecting capacitor provided between the terminal which should have a stable potential and a terminal having a fixed potential, and detects a variation in voltage by monitoring a transient current flowing through the detecting capacitor upon a variation in voltage at the terminal which should have a stable potential.

9. The linear regulator circuit according to claim 8, wherein the auxiliary circuit amplifies the transient current flowing through the detecting capacitor to provide feedback so as to increase a bias current of a differential amplifier circuit provided in an input stage of the error amplifier.

10. The linear regulator circuit according to claim 9, wherein the auxiliary circuit also amplifies a transient current flowing through the detecting capacitor to provide feedback so as to increase a bias current of an amplifier transistor which amplifies an output signal from the differential amplifier circuit.

11. The linear regulator circuit according to claim 8, wherein the auxiliary circuit amplifies the transient current flowing through the detecting capacitor to provide feedback to an output terminal of the differential amplifier circuit provided in the input stage of the error amplifier.

12. The linear regulator circuit according to claim 7, wherein the detection circuit includes a detecting capacitor and a first transistor which are serially provided between the terminal which should have a stable potential and a terminal having a fixed potential, and the auxiliary circuit includes a second transistor which forms a current mirror circuit with the first transistor, to enhance the response speed of the error amplifier by a current flowing through the second transistor.

13. An automobile comprising:

a battery; and the linear regulator circuit according to claim 7 which stabilizes a voltage from the battery for output to a load.

14. A linear regulator circuit comprising:

an output transistor provided between an input terminal and an output terminal;

an error amplifier which adjusts a voltage at a control terminal of the output transistor so that an output voltage appearing at the output terminal approaches a desired voltage; and a detecting feedback capacitor which is connected between a terminal which should have a stable potential to stabilize the output voltage, the terminal being the input terminal or the output terminal, and a bias current source of a differential amplifier circuit provided in an input stage of the error amplifier.

15. An automobile comprising:

a battery; and the linear regulator circuit according to claim 14 which stabilizes a voltage from the battery for output to a load.

16. A linear regulator circuit comprising:

an output transistor provided between an input terminal and an output terminal;

an error amplifier which adjusts a voltage at a control terminal of the output transistor so that an output voltage appearing at the output terminal approaches a desired voltage; and a detecting feedback capacitor which is connected between a terminal which should have a stable potential to stabilize the output voltage, the terminal being the input terminal or the output terminal, and an output terminal of a differential amplifier circuit provided in an input stage of the error amplifier.

17. An automobile comprising:

a battery; and the linear regulator circuit according to claim 16 which stabilizes a voltage from the battery for output to a load.

* * * * *